US007165349B2

(12) United States Patent
Bauer

(10) Patent No.: US 7,165,349 B2
(45) Date of Patent: Jan. 23, 2007

(54) ATTACHABLE CARD HOLDER

(75) Inventor: Witold Bauer, Westlake, OH (US)

(73) Assignee: Allegiance Corporation, McGaw Park, IL (US)

( * ) Notice: Subject to any disclaimer, the term of this patent is extended or adjusted under 35 U.S.C. 154(b) by 0 days.

(21) Appl. No.: 11/010,255

(22) Filed: Dec. 13, 2004

(65) Prior Publication Data

US 2006/0162210 A1 Jul. 27, 2006

(51) Int. Cl.
*G09F 3/08* (2006.01)

(52) U.S. Cl. ..... 40/654; 40/661.08

(58) Field of Classification Search ..... 40/652, 40/657–659, 647–648, 661.08, 740, 739, 40/794, 792
See application file for complete search history.

(56) References Cited

U.S. PATENT DOCUMENTS

| | | | | | |
|---|---|---|---|---|---|
| 865,886 | A | | 9/1907 | Guinn | |
| 1,494,644 | A | * | 5/1924 | Taussig | 40/658 |
| 1,668,059 | A | * | 5/1928 | Egan | 40/651 |
| 1,690,218 | A | * | 11/1928 | Egan | 40/651 |
| 4,356,646 | A | | 11/1982 | Johnson, Jr. | 40/16.4 |
| 4,616,435 | A | | 10/1986 | Perfect | 40/6 |
| 5,020,255 | A | | 6/1991 | Rodel | 40/654 |
| 5,038,926 | A | | 8/1991 | van der Toorn | 206/393 |
| 5,125,505 | A | | 6/1992 | Kurosaki | 206/39.4 |
| 5,448,844 | A | | 9/1995 | Miller, Jr. et al. | 40/611 |
| 5,552,790 | A | | 9/1996 | Gunnarsson | 342/51 |
| 5,592,767 | A | | 1/1997 | Treske | 40/649 |
| 5,609,252 | A | | 3/1997 | Koch | 206/455 |
| 5,938,010 | A | | 8/1999 | Osterbye | 206/38 |
| 6,012,411 | A | | 1/2000 | Hochbrueckner | 116/207 |
| 6,050,014 | A | | 4/2000 | Ohlson | 40/649 |
| 6,155,456 | A | | 12/2000 | Archer | 221/231 |
| 6,374,523 | B1 | | 4/2002 | Smith | 40/611 |
| 6,592,003 | B1 | | 7/2003 | Silverthorne | 221/60 |
| 2002/0065106 | A1 | | 5/2002 | Bishop et al. | 455/558 |

* cited by examiner

*Primary Examiner*—Cassandra Davis
(74) *Attorney, Agent, or Firm*—Andrew G. Rozycki; Timothy Czaja

(57) ABSTRACT

The invention disclosed herein provides a card holder device that can be attached to another object and hold a card therein in a fixed position relative to the object in a readily viewable position during the handling and/or processing of the object to which it is attached. The attachable card holder device comprises a generally planar face portion structured to receive and secure a card therein, the planar face portion having a first attachment leg extending from a first end of said face portion and a second attachment leg extending from a second end of said face portion, wherein the wherein said planar face portion, first and second attachment legs collectively form an overall bracket configuration. The planar face portion comprises a card receiving structure that can comprise a multi-sided frame surrounding an open central area, and a flexible back plate integrally hinged at one end, wherein the back plate is biased outward.

2 Claims, 7 Drawing Sheets

ATTACHABLE CARD HOLDER

FIELD OF THE INVENTION

The invention relates to a device for holding a card for viewing. In particular, the invention pertains to a card holding device that is structured for attachment to another object.

BACKGROUND OF THE INVENTION

A variety of card holders, that is devices structured to hold and retain cards while at the same time permitting their viewing, are known. Such card holders commonly take the form of luggage tags, business card dispensers, or advertising display signs. Typically, such card holders are structured to removably accommodate a card or sign that can be inserted into a planar portion of the holder, where the card is viewably secured therein. Examples of card holders are described in: the attachable tags such as those of Rodel et al., U.S. Pat. No. 5,020,255, Osterbye U.S. Pat. No. 5,938,010, van der Toorn U.S. Pat. No. 5,038,926, and Perfect U.S. Pat. No. 4,616,435; the card dispensers of Silverthorne U.S. Pat. No. 6,592,003, and Archer U.S. Pat. No. 6,155,456; identification card holders such as Treske U.S. Pat. No. 5,592,767; and displays such as those of Kurosaki U.S. Pat. No. 5,125,505, Smith U.S. Pat. No. 6,374,523, and Miller, Jr. et al. U.S. Pat. No. 5,448,844.

Sterilization indicator cards and data or information cards are often used in the medical field. Such cards can be constructed of a metallic plate or stiff paper backing containing a chemical composition therein which is responsive to a particular sterilization technique used, e.g., ethylene oxide gas, autoclave temperature sterilization, and the like. Sterilization cards are sometimes placed in a card "stand" which in turn is placed inside the sterilization chamber alongside the device(s) to be sterilized. The card surface is then viewed at the conclusion of the sterilization process to indicate whether the predetermined sterilization conditions occurred inside the chamber. One disadvantage associated with separate sterilization and information data cards and card "stands" is that they are not attached to the device when the device is placed in or removed from the sterilization apparatus. Thus, the benefits of readily viewing the card to determine the sterilization status of the device are temporary or transitional.

Another type of card holder used in the medical field is a data card tag attached to a medical device by a loop or chain, for example. The data cards can contain certain information on the face of the card about the device to which it is attached. One disadvantage of the "tag" type of card holder is that the neither the card nor the card holder are in a fixed or secured position, thereby allowing the card to move about and hence occasionally obscure its readability.

There exists a need in the medical field for a card holder that continually remains attached to an object and which holds a card in the same fixed position throughout the duration of its handling until intentionally removed. Further advantageous would be such a card holder that retains the card in a fixed and readily viewable position that reduces the likelihood that viewing the card surface can become obscured by movement during handling of the object. Even more desirable would be a card holder that can be easily and cost-effectively manufactured.

SUMMARY OF THE INVENTION

The invention provides a card holder device that can be attached to another object, such as to the exterior of a sterilization container for medical devices, and hold a card therein in a fixed position relative to the object. It has been discovered that a card holder can be constructed to attach to and accompany another object and hold the card in a readily viewable position in a fixed manner during the handling and/or processing of the object to which it is attached. The invention, therefore, is absent the disadvantages associated with dangling-type card tags, or adhesive stickers. Furthermore, the card holder of the invention can be constructed to contain these advantages and be structured to include attachment elements that specifically cooperate with a particular device, such as a container or packaging.

The invention provides an attachable card holder device structured to position a card in a rigid fixed and spaced apart position relative to another object to which said device can be attached, said card holder device comprising:

- a generally planar face portion structured to receive and secure a card therein, said planar face portion having a first attachment leg extending from a first end of said face portion and a second attachment leg extending from a second end of said face portion, wherein said first attachment leg and second attachment leg extend in the same direction and have a bend angle of about 90 degrees relative to the planar face portion;
- wherein said planar face portion, first and second attachment legs collectively form an overall bracket configuration; and
- wherein said first attachment leg comprises a first coupling element, and said second attachment leg comprises a second coupling element, each of said coupling elements located on the ends of said legs distal to the planar face portion.

In a preferred embodiment, the planar face portion of the card holder device comprises a card receiving structure comprising a multi-sided frame surrounding an open central area, and a flexible back plate integrally hinged at one end and positioned behind said central area and biased outward. The frame sides and back plate cooperate such that a card inserted behind the frame and in front of said back plate is urged outward so that edges of the card contact the inner surfaces of the frame sides and secure the card in place. In an even more preferred embodiment, the end of the back plate opposite the integrally hinged end further comprises a ridge inhibiting lateral movement of a card positioned in the when residing in the planar face portion.

The invention further provides a card display system comprising the attachable card holder device as described above in combination with a card.

BRIEF DESCRIPTION OF THE DRAWINGS

The invention is further illustrated by the following drawings, none of which are to be construed as necessarily limiting the invention.

DETAILED DESCRIPTION OF THE INVENTION

The invention provides a card holder device that can be attached to another object. A wide variety of objects can be used in conjunction with the attachable card holder of the invention. It is contemplated, however, that the attachable card holder of the invention is particularly useful together with objects, such as medical devices or medical device containers, wherein information that may be present on a card accompanying the object should be readily viewable and the information is important or critical to the usage of the object or its contents. Accordingly, when attached to an object, a card is held in a secured, fixed, and readily viewable position relative to the object and remains thereon throughout the handling of the object until intentionally removed by the user.

Figure 1:
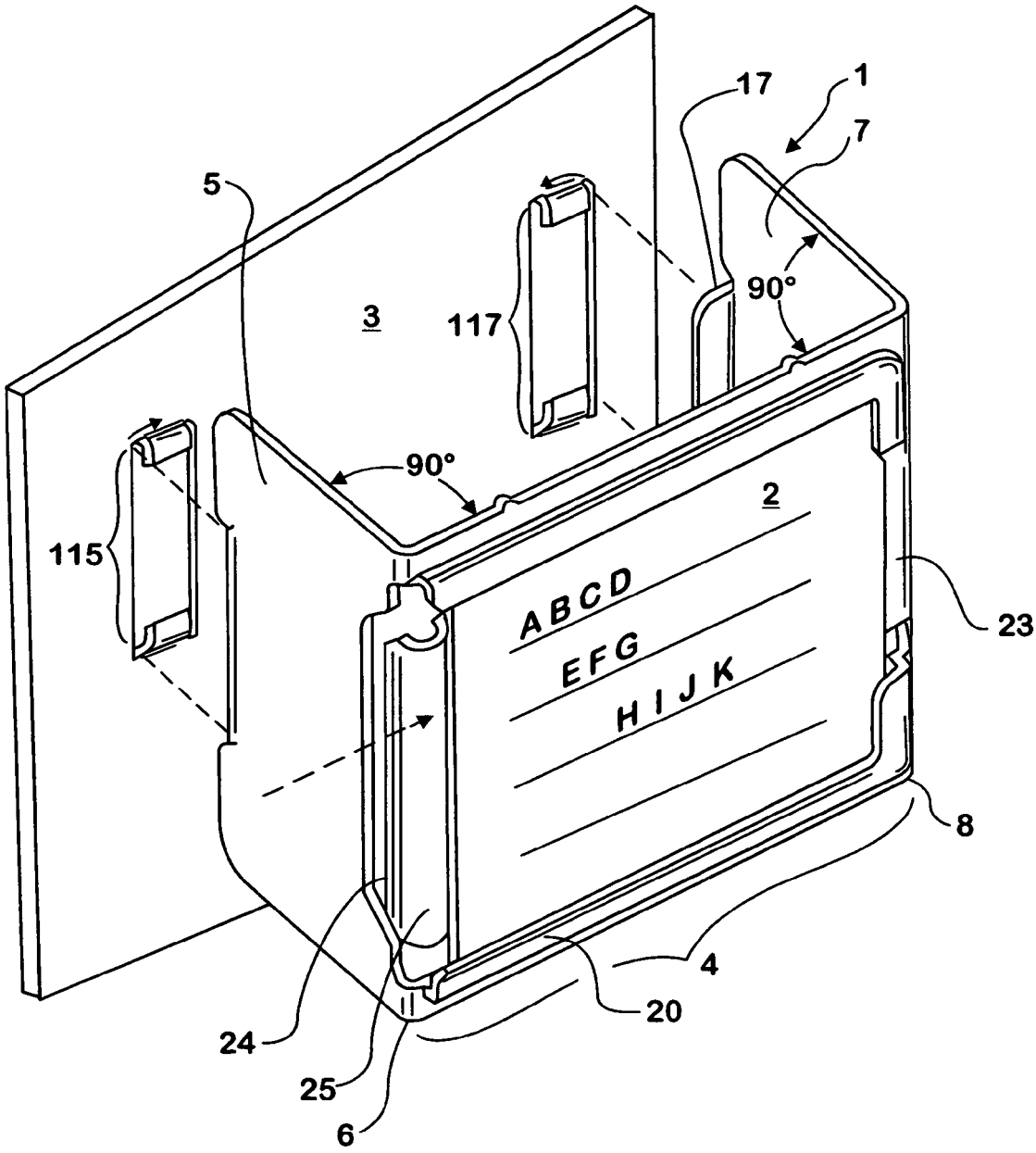
FIG. 1 is an overall view of the card holder device containing a card therein and object for attachment according to one embodiment of the invention.
Figure 6:
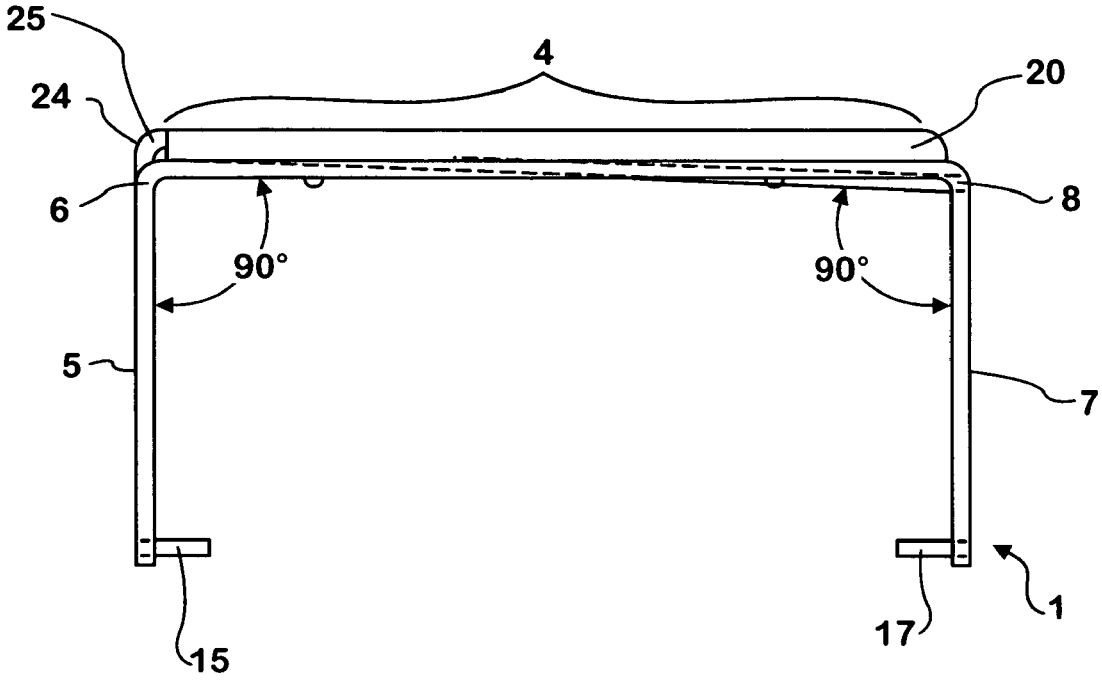
FIG. 6 is a top view of the card holder device according to one embodiment of the invention.

Referring now to FIG. 1, in general the invention provides an attachable card holder device 1 structured to position a card 2 in a rigid fixed and spaced apart position relative to another object 3 to which said device 1 can be attached. Information located on the card 2, illustrated in FIG. 1 as alphabetical letters on the face of the card 2, can be readily viewed by the user. In contrast to dangling-type card holders secured to devices by loops or chains, the card holder device 1 of the invention is not subject to migration or "flipping" that obstructs the viewing of the information on the card. The card holder device 1 comprises a generally planar face portion 4 structured to receive and secure a card 2 therein. The planar face portion 4 has a first attachment leg 5 extending from a first end 6 of the face portion 4 and a second attachment leg 7 extending from a second end 8 of the face portion 4. The first attachment leg 5 and second attachment leg 7 extend in the same direction (e.g., rearward) and have a bend angle of about 90 degrees relative to the planar face portion 4 as shown in FIG. 6, for example. As can be seen from FIGS. 1 through 3 and 6, the planar face portion 4, first attachment leg 5 and second attachment leg 7 collectively form an overall bracket configuration, or squared The dimensions of the planar face portion and attachment legs can vary. For example, the attachment legs can vary in length or width, or both. The dimensions can be adjusted to perform additional functions. For instance, the card holder device can be dimensioned to serve as a shield or cover for structures on the object located behind the card holder device when affixed to the object surface, such as latches, locks, handles, and the like.

Figure 2:
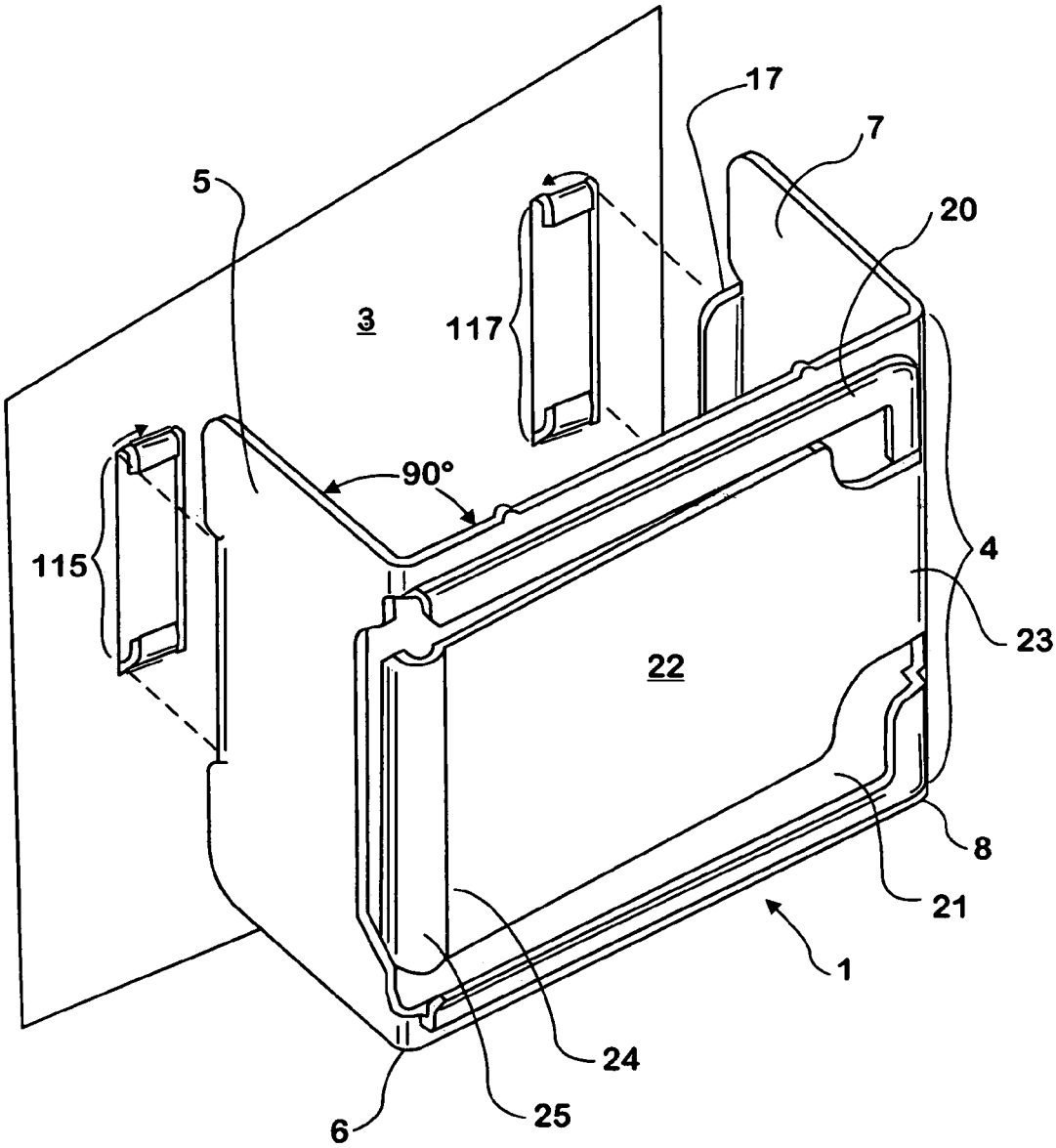
FIG. 2 is an overall angled side view of the card holder device of the invention without the card and an object for attachment according to one embodiment of the invention.
Figure 3:
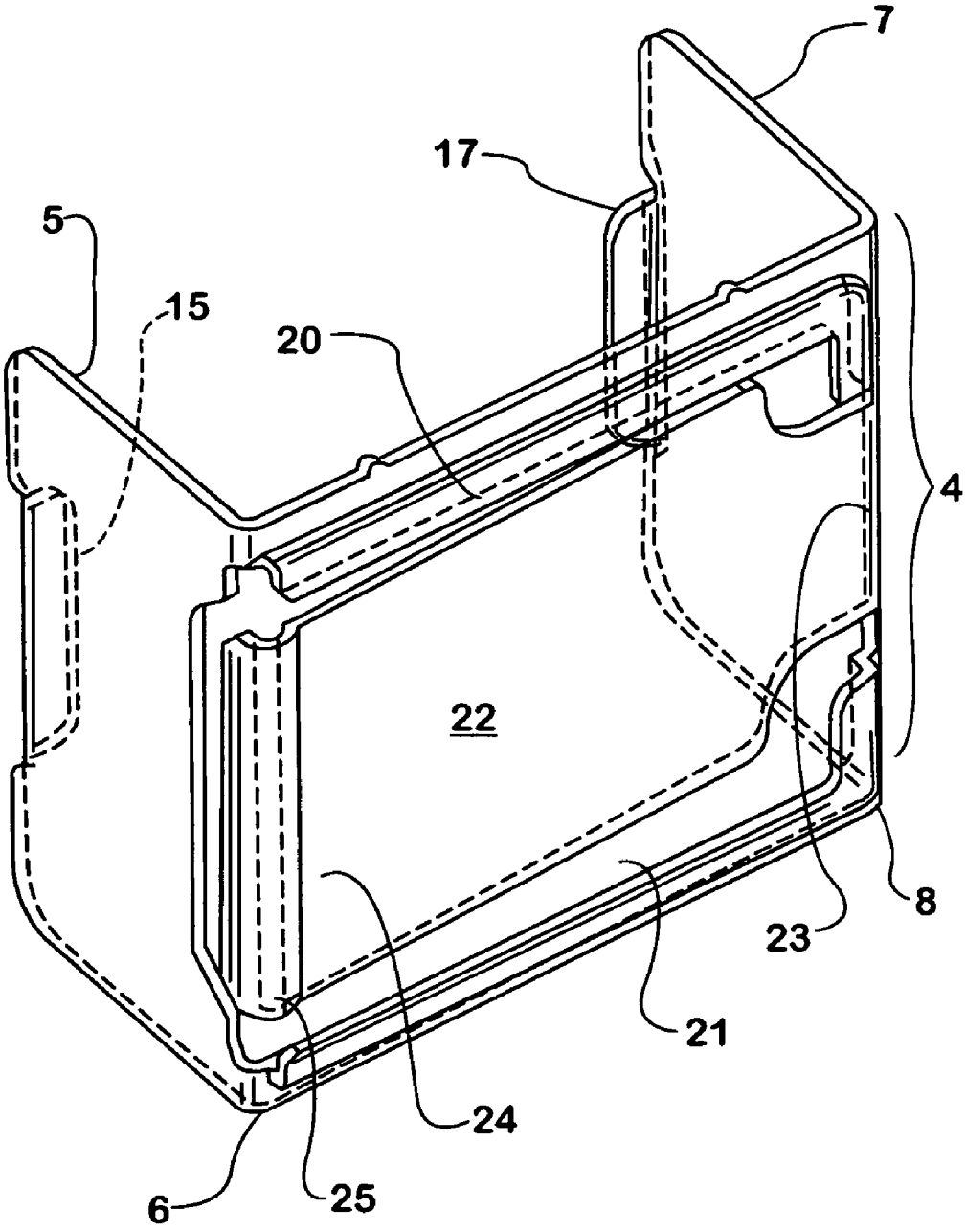
FIG. 3 is a transparent angled side view of the card holder device according to one embodiment of the invention.
Figure 4:
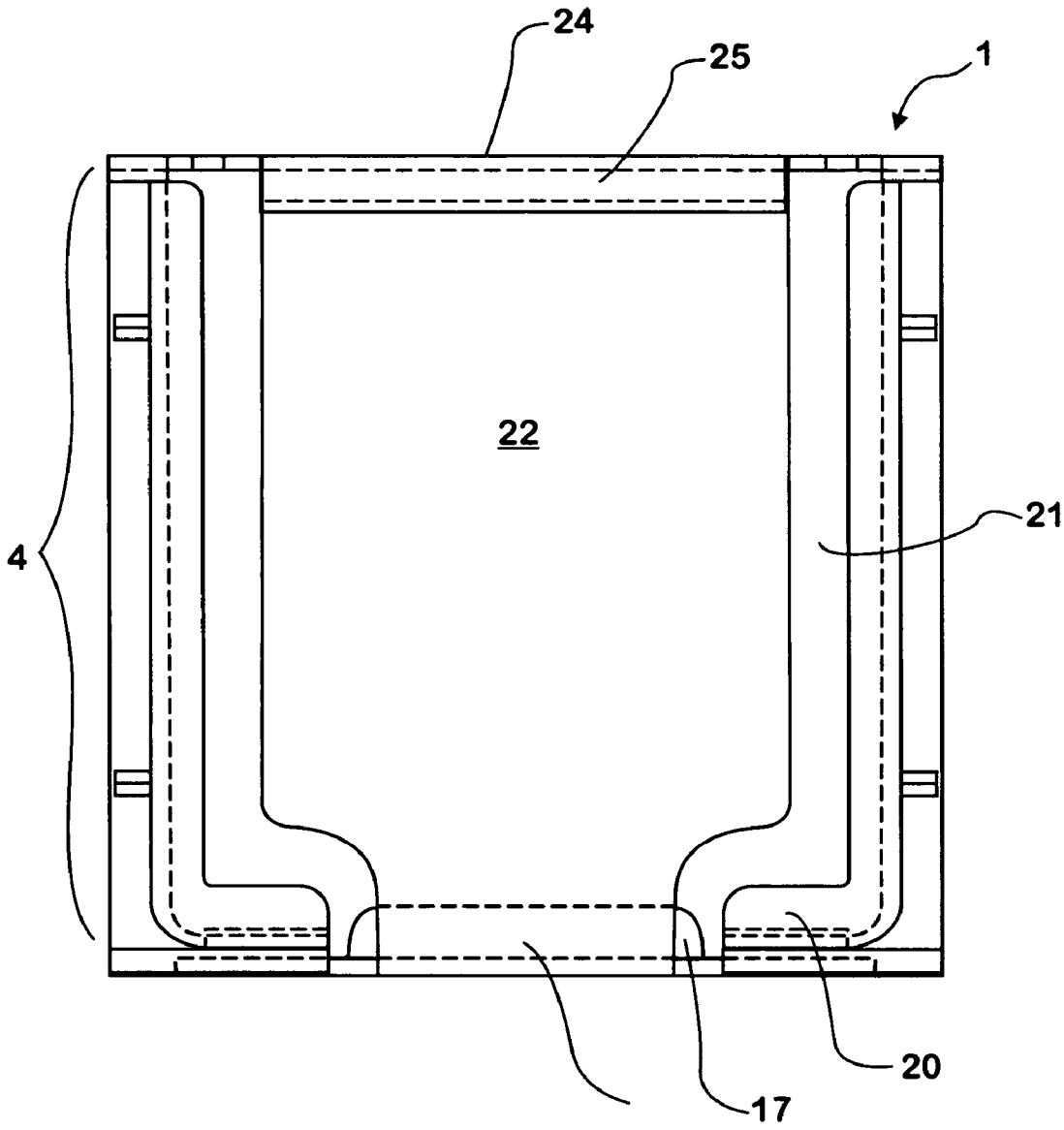
FIG. 4 is a front view of the card holder device according to one embodiment of the invention.
Figure 5:
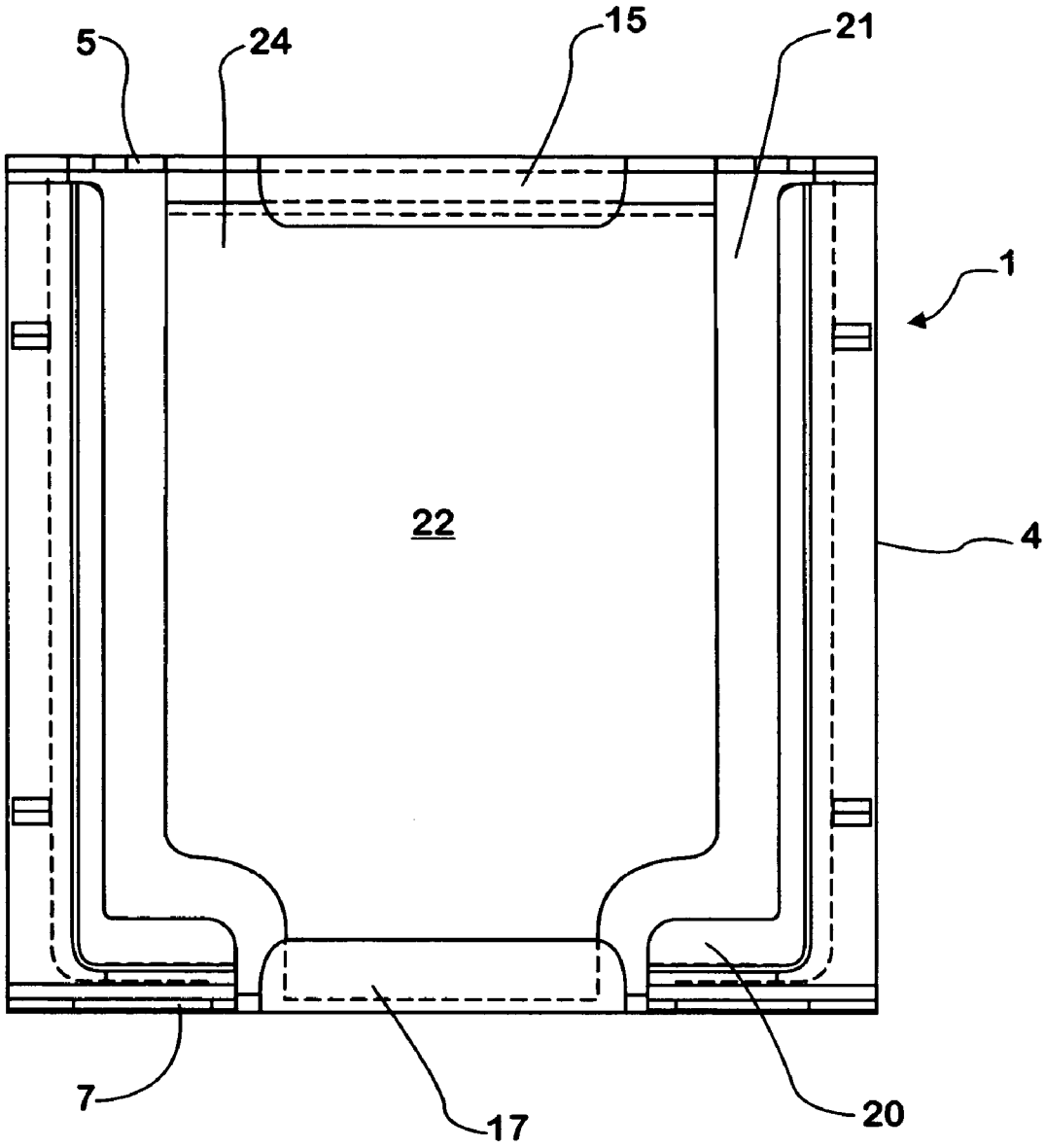
FIG. 5 is a rear view of the card holder device according to one embodiment of the invention.

The first attachment leg 5 comprises a first coupling element 15 (see FIG. 3), and the second attachment leg 7 comprises a second coupling element 17. Each of the coupling elements, 15 and 17 respectively, are located on the ends of the attachment legs 5 and 7, respectively, opposite or distal to the end of the legs proximal to the planar face portion ends 6 and 8, respectively. The coupling elements can have a variety of configurations provided each cooperates with a corresponding structure on the object to which the card holder device is to be attached. In FIGS. 1 and 2, an object 3 is depicted having a corresponding coupling element receiving structures 115 and 117 in the form of brackets that slidably receive coupling elements 15 and 17, respectively, therein. Other coupling element and coupling element receiving structures are possible, such as tab-and-slot, peg-and-hole, and the like.

Figure 7:
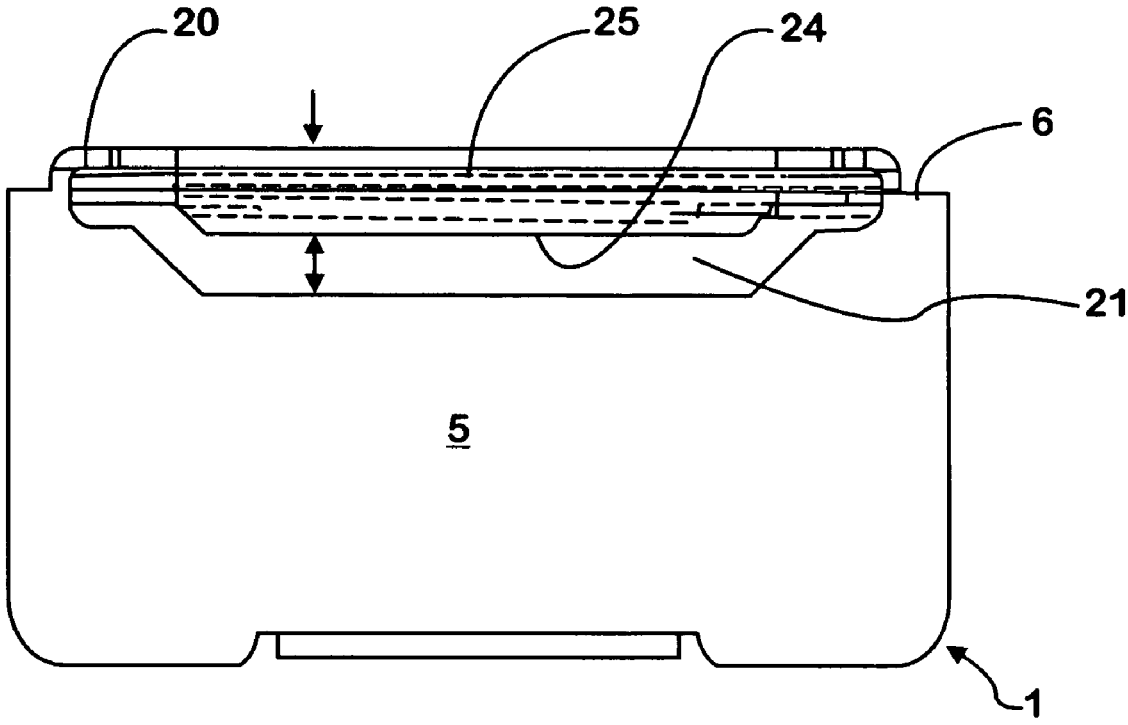
FIG. 7 is an end view of the card holder device according to one embodiment of the invention.

The planar face portion 4 of the card holder device comprises a card receiving structure. In a preferred embodiment and as depicted in the figures, the card receiving structure comprises a multi-sided frame 20 surrounding an open central area 21 (see FIGS. 2 through 5), and a flexible back plate 22 integrally hinged at a hinge end 23 and positioned within the open central area 21 and biased outward. Referring now to FIG. 1, the frame 20 and back plate 22 cooperate such that a card 2 inserted between the frame 20 and in front of the back plate 22 is urged outward so that edges of the card 2 contact the inner surface(s) of the frame 20 and function to secure the card 2 in place. Within the context of the back plate, the term "flexible" is meant to define the ability of the plate to be depressed and subsequently upon release, return to its initial position. The flexibility range of the back plate is illustrated in FIG. 7, for example.

The multi-sided frame 20 comprises at least two opposing frame segments. In the figures and for illustration, the frame 20 is shown as having two partial frame segments, two opposing segments and a partial third frame segment adjacent the hinged end 23 of back plate 22. Alternatively, the frame 20 can be structured as a series of interrupted frame segments surrounding the open central area 21. A variety of frame configurations can be used provided the card can be held in place and lateral migration or movement of the card is prevented.

The back plate 22 includes an insertion end 24 opposite the hinge end 23. In a preferred embodiment, the insertion end 24 further comprises a ridge 25 or stops that inhibit lateral movement of a card 2 (see FIG. 1) once positioned and residing in the planar face portion 4.

The invention further provides a card display system comprising the attachable card holder device as described above, in combination with a card placed therein. The system can further comprise a transparent cover or shield (not shown) interposed between the card and frame.

The card holder device of the invention can be one piece integrally molded from plastic, or forged from a single sheet of metal in accordance with conventional techniques and equipment readily available to those skilled in the art. The preferred embodiment of the invention as illustrated in the figures affords the manufacturer the significant advantage of permitting the card holder device of the invention to be formed (die cut and bent) from a single sheet of metal, such as aluminum or stainless steel. Thus, the invention further offers the advantage of ease and simplicity of manufacture.

The attachable card holder device of the invention can be initially attached onto the object, and the card can be inserted secondly. Alternatively, the card can be initially inserted into the card holder, and then the card holder together with the card secured therein attached onto the object. To insert a card into the card holder device of the invention, the user simply depresses the flexible back plate at the fee end opposite the hinge end (see FIG. 7), sliding the card between the frame and back plate ensuring the edges of the card reside behind the frame, and then releasing the back plate. In addition to the outward bias of the back plate, the card can be prevented from migrating or moving laterally by a ridge or stop located at the free end of the back plate. Referring to FIG. 1, the card edge abuts ridge 25 of the free end 24 of the back plate, which in resting position positions the ridge 25 generally flush with the frame 20. When a card 2 is placed in the card holder of the invention, the result is a card that is prevented from unintentional movement in any direction.

INDUSTRIAL APPLICABILITY

The invention is useful to attach a card onto an object in a fixed position and location on the object, and to ensure that the card and the information thereon, accompany the object throughout its handling and/or processing until intentionally removed. The invention is particularly useful to attach information cards to medical device containers or packaging, and can be constructed to specifically attach to a particular object.

The invention has been described herein above with reference to various and specific embodiments and techniques. It will be understood that reasonable modifications and variations of such embodiments and techniques are possible without significantly departing from either the spirit or scope of the invention defined by the claims set forth below.

What is claimed is:

1. An attachable card holder device structured to position a card in a rigid fixed and spaced apart position relative to another object to which said device can be attached, said card holder device comprising:

a generally planar face portion structured to receive and secure said card therein, said planar face portion having a first attachment leg extending from a first end of said face portion and a second attachment leg extending from a second end of said face portion, wherein said first attachment leg and second attachment leg extend in the same direction and have a bend angle of about 90 degrees relative to the planar face portion;

wherein said planar face portion, first and second attachment legs collectively form an overall bracket configuration;

wherein said first attachment leg comprises a first coupling element, and said second attachment leg comprises a second coupling element, each of said first and second coupling elements located on the ends of each of said first and second attachment legs, respectively, distal to the planar face portion;

wherein said planar face portion further comprises multi-sided frame surrounding an open central area, and a flexible back plate having a hinge end and an insertion end including a ridge, said back plate being positioned within said central open area, wherein said back plate is biased outward; and wherein the frame and back plate cooperate such that a card inserted between the frame and back plate is urged outward so that edges of the card contact the inner surface of the frame thereby securing the card in place, said ridge inhibiting lateral movement of the card.

2. A card display system comprising the attachable card holder device according to claim 1 in combination with a card.

* * * * *